US008490970B2

(12) United States Patent
Mutsuno

(10) Patent No.: US 8,490,970 B2
(45) Date of Patent: Jul. 23, 2013

(54) PRINTING APPARATUS, CONTROL METHOD THEREFOR, AND STORAGE MEDIUM

(75) Inventor: Masahiro Mutsuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/544,572

(22) Filed: Jul. 9, 2012

(65) Prior Publication Data

US 2013/0020760 A1 Jan. 24, 2013

(30) Foreign Application Priority Data

Jul. 21, 2011 (JP) ..... 2011-160306

(51) Int. Cl.
*B65H 29/00* (2006.01)

(52) U.S. Cl.
USPC ..... 271/298; 271/288

(58) Field of Classification Search
USPC ..... 271/298, 288
See application file for complete search history.

(56) References Cited

U.S. PATENT DOCUMENTS

2006/0056859 A1* 3/2006 Otani ..... 399/16
2007/0253723 A1* 11/2007 Fujii et al. ..... 399/75

* cited by examiner

*Primary Examiner* — Luis A Gonzalez
(74) *Attorney, Agent, or Firm* — Fitzpatrick, Cella, Harper & Scinto

(57) ABSTRACT

When a sheet processing apparatus is newly connected, discharge of sheets to a paper discharge tray the user does not intend is prevented while omitting cumbersome settings regarding the sheet processing apparatus. To accomplish this, a printing apparatus stores, in storage unit, information for determining a paper discharge destination to which sheets are to be discharged from among a plurality of paper discharge destinations. In a case where a newly connected sheet processing apparatus is a sheet processing apparatus of the same type as an immediately previously connected sheet processing apparatus, the printing apparatus does not change the information stored in the storage unit. In a case where a newly connected sheet processing apparatus is a sheet processing apparatus of a different type, the printing apparatus updates the information stored in the storage unit.

9 Claims, 8 Drawing Sheets

PRINTING APPARATUS, CONTROL METHOD THEREFOR, AND STORAGE MEDIUM

BACKGROUND OF THE INVENTION

1. Field of the Invention

The present invention relates to a printing apparatus, capable of discharging sheets to a sheet processing apparatus including a plurality of paper discharge trays, a control method therefor, and a storage medium.

2. Description of the Related Art

There have conventionally been proposed image forming apparatuses capable of connecting sheet processing apparatuses for performing stapling and folding. Most sheet processing apparatuses include a plurality of paper discharge trays for outputting a printed material. Some image forming apparatuses assign a tray for output in accordance with a function such as the copy function or FAX function, or an application purpose. For a tray in the sheet processing apparatus, setting data of a tray for output is saved and managed not in the internal non-volatile memory of the sheet processing apparatus but in the internal non-volatile memory of the image forming apparatus in accordance with the function of the image forming apparatus.

However, the conventional technique has the following problem. For example, a paper discharge destination indicating a paper discharge tray to which sheets are to be preferentially discharged is set in the internal non-volatile memory of the image forming apparatus for each function such as "copy" or "print". In some cases, after a sheet processing apparatus connected to the image forming apparatus is disconnected from it, a sheet processing apparatus of a different type is newly connected to it. In this case, the newly connected sheet processing apparatus may differ in paper discharge tray count from the immediately previously connected sheet processing apparatus. If the image forming apparatus determines a paper discharge destination in accordance with the previous setting, sheets may be discharged to a paper discharge tray the user does not intend. To prevent this, the conventional technique clears the paper discharge destination setting in the non-volatile memory upon disconnecting a sheet processing apparatus, and sets a paper discharge destination again upon reactivation. Even when the serviceperson temporarily disconnects a sheet processing apparatus for maintenance, the paper discharge destination setting is cleared, so s/he needs to set the paper discharge destination again. After the maintenance, sheets may be discharged to a paper discharge destination different from the previous one owing to a setting error by the serviceperson or the like, and the user can be confused.

SUMMARY OF THE INVENTION

The present invention enables realization of a mechanism of, when a sheet processing apparatus is newly connected, preventing discharge of sheets to a paper discharge tray the user does not intend while omitting cumbersome settings regarding the sheet processing apparatus.

One aspect of the present invention provides a printing apparatus, connectable to a sheet processing apparatus including a plurality of paper discharge destinations, comprising: a storage control unit that stores, in a storage unit, information for determining a paper discharge destination to which a sheet is to be discharged from among the plurality of paper discharge destinations; and a control unit that, in a case where a newly connected sheet processing apparatus is a sheet processing apparatus of the same type as an immediately previously connected sheet processing apparatus, does not change the information stored in the storage unit, and in a case where a newly connected sheet processing apparatus is a sheet processing apparatus of a different type, updates the information stored in the storage unit.

Another aspect of the present invention provides a method for controlling a printing apparatus, connectable to a sheet processing apparatus including a plurality of paper discharge destinations, comprising: storing, in a storage unit, information for determining a paper discharge destination to which a sheet is to be discharged from among the plurality of paper discharge destinations; and in a case where a newly connected sheet processing apparatus is a sheet processing apparatus of the same type as an immediately previously connected sheet processing apparatus, not changing the information stored in the storage unit, and in a case where a newly connected sheet processing apparatus is a sheet processing apparatus of a different type, updating the information stored in the storage unit.

Still another aspect of the present invention provides a computer-readable storage medium storing a computer program for causing a computer to execute a method for controlling a printing apparatus, connectable to a sheet processing apparatus including a plurality of paper discharge destinations, the program comprising: storing, in a storage unit, information for determining a paper discharge destination to which a sheet is to be discharged from among the plurality of paper discharge destinations; and in a case where a newly connected sheet processing apparatus is a sheet processing apparatus of the same type as an immediately previously connected sheet processing apparatus, not changing the information stored in the storage unit, and in a case where a newly connected sheet processing apparatus is a sheet processing apparatus of a different type, updating the information stored in the storage unit.

Further features of the present invention will be apparent from the following description of exemplary embodiments with reference to the attached drawings.

DESCRIPTION OF THE EMBODIMENTS

Figure 1:
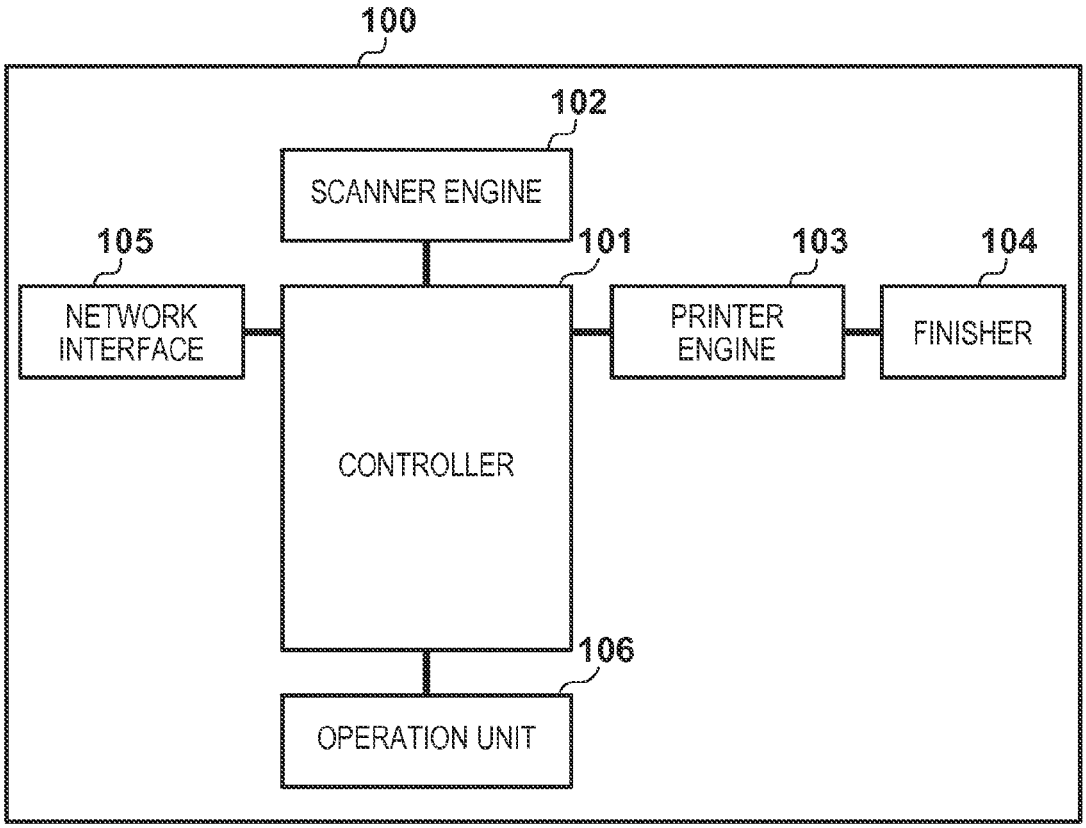
FIG. 1 is a block diagram showing the overall arrangement of an image forming apparatus according to the first embodiment.

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<First Embodiment>

<Arrangement of Image Forming Apparatus>

The first embodiment will be described below with reference to FIGS. 1 to 6. First, the arrangement of an MFP (Multi-Function Peripheral) will be explained as an example of the image forming apparatus according to the embodiment with reference to FIG. 1. An MFP 100 includes a controller 101, scanner engine 102, printer engine 103, finisher 104, network interface 105, and operation unit 106.

Figure 2:
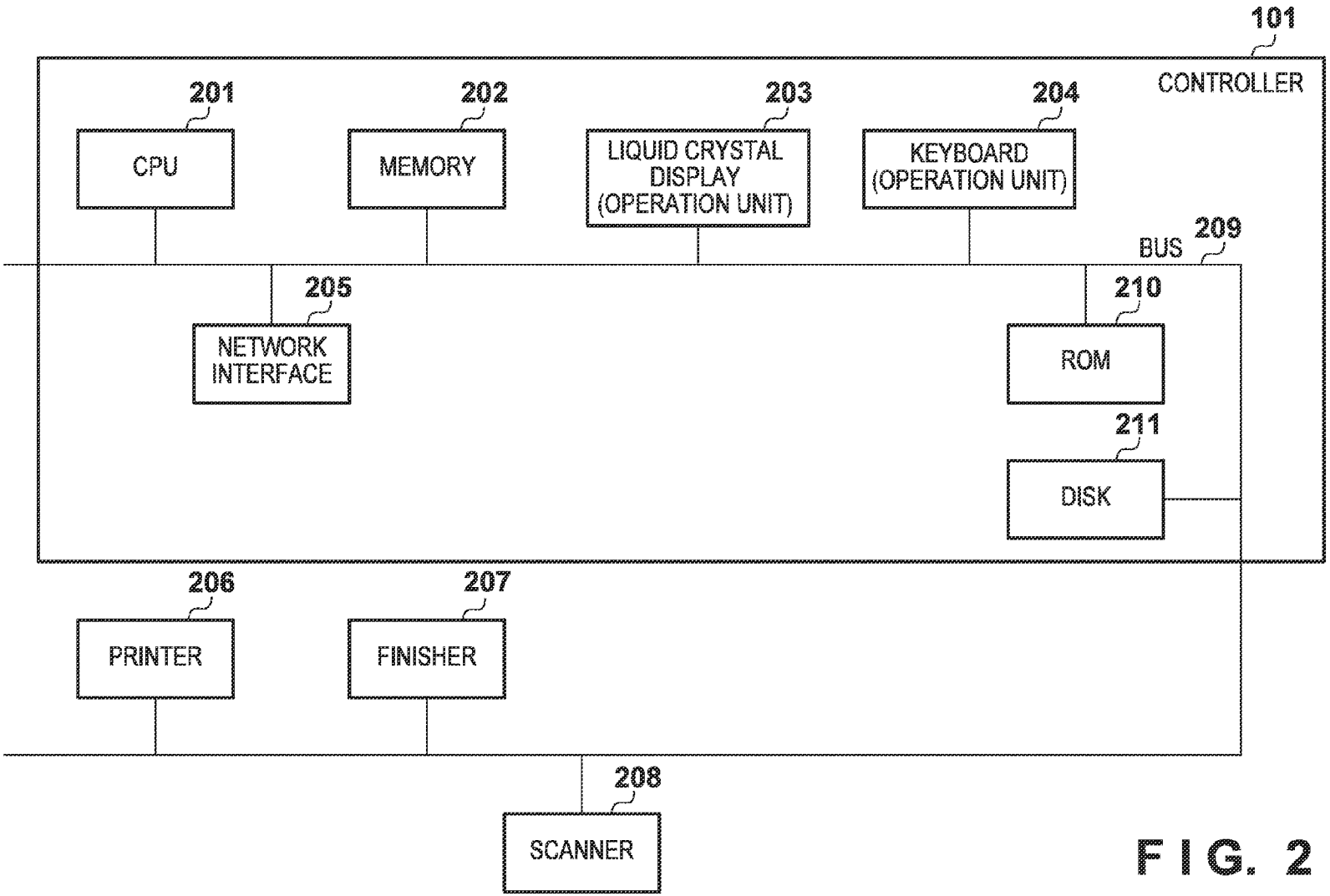
FIG. 2 is a block diagram showing the overall arrangement of an image forming system according to the first embodiment.

The controller 101 controls the MFP, and includes a hardware arrangement shown in FIG. 2. The scanner engine 102 is controlled by the controller 101, and controls a scanner 208 to be described later. The printer engine 103 is controlled by the controller 101, and controls a printer 206 to be described later. The finisher 104, which is a representative device among sheet processing apparatuses (accessory apparatuses), is connected to the printer engine 103, and can staple at once (staple together) a plurality of printing media (for example, sheets) output from the printer engine. The finisher 104 is detachable from the printer engine 103, and even an arrangement with the single printer engine 103 not connected to the finisher 104 normally operates. A plurality of sheet processing apparatuses can be connected to the MFP 100.

The controller 101 also controls the finisher 104. The network interface (Ethernet®) 105 provides two-way communication to the controller 101 via the network interface 105. The operation unit or user interface 106 is formed from an LCD display and keyboard, displays information from the controller 101, and notifies the controller 101 of an instruction from the user (operator). All functions are usable regardless of network interface (Ethernet® or TCP/IP).

<Controller Arrangement>

Next, the hardware arrangement of the controller 101 according to the embodiment will be described with reference to FIG. 2. In the controller 101, a CPU 201 is connected via a bus 209 to a memory 202, a liquid crystal display 203 and keyboard 204 which form the operation unit 106, a ROM 210, and a DISK 211.

Various programs and data are stored in the DISK 211 (storage medium) such as a hard disk or floppy® disk, and if necessary, sequentially read out to the memory 202 and executed by the CPU 201. The DISK 211 may be removable from the MFP 100 or incorporated in it. A program may be downloaded from another MFP via a network and stored in the DISK 211. Memories include non-volatile memories such as a DRAM and volatile memories such as an SRAM. The memory 202 may have both the functions of the volatile memory and non-volatile memory. Alternatively, the memory 202 may have the function of the volatile memory, and the DISK 211 may have the function of the non-volatile memory. The memory 202 may be a removal storage medium.

The liquid crystal display 203 and keyboard 204 form the operation unit 106 shown in FIG. 1. The CPU 201 writes data to present a display on the liquid crystal display 203. The CPU 201 accepts an instruction from the user via the keyboard 204 or the touch panel of the liquid crystal display 203. The accepted information is transferred to and accumulated in one of the memory 202, DISK 211, and CPU 201, and used for various processes.

A network interface 205 is connected to the bus 209, and corresponds to the network interface 105 shown in FIG. 1. Communication using the interface is performed by reading or writing data from or in the interface by the CPU 201. Further, the printer 206, a finisher 207, and the scanner 208 are connected to the bus 209 via the scanner engine 102 and printer engine 103 shown in FIG. 1. The CPU 201 reads out and writes data from and within these engines to execute engine operations for printing, scanning, and the like, and acquire various statuses.

Image data can be saved in the DISK 211 or memory 202 within the controller 101 from the scanner 208 or the network interface 105. It is also possible to accumulate image data in the removable memory 202 in advance, attach the memory to the controller 101, and input the image data. Image data accumulated in the DISK 211 can be moved or copied to the memory 202. Various additional images (for example, page printing number) can be composited to image data in the memory in accordance with contents designated via the operation unit 106. Note that the printer 206, finisher 207, and scanner 208 may exist not in the MFP 100 but as single peripheral devices on a network, and may be controlled by the controller 101 of the MFP 100. The finisher 207 is equivalent to the finisher 104 shown in FIG. 1 and detachable from the printer engine 103. The finisher 207 is connected to the printer engine 103, and controlled by the CPU 201.

<Outer Appearance of Image Forming Apparatus>

Figure 3:
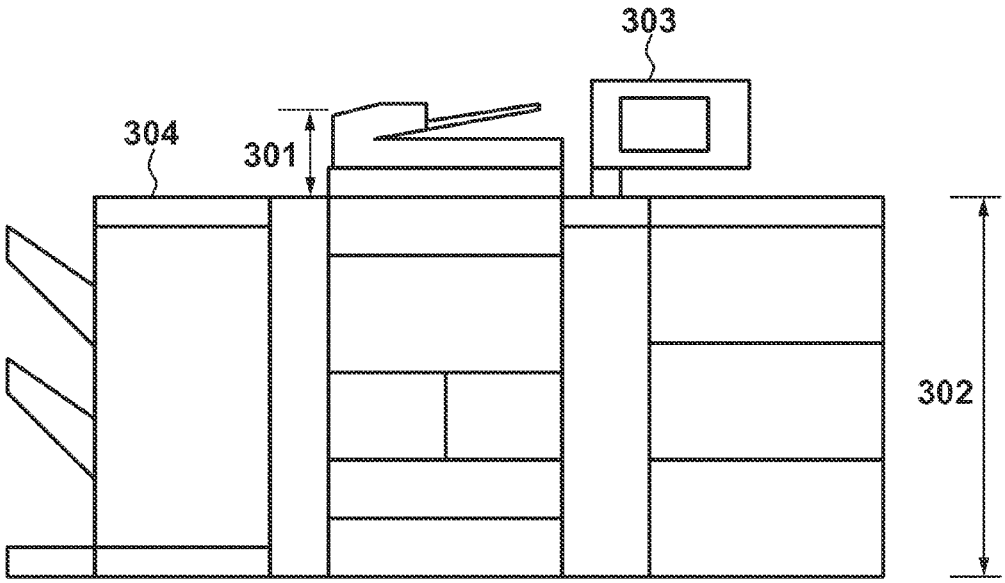
FIG. 3 is a view showing the outer appearance of the input/output device of the image forming apparatus according to the first embodiment.

The outer appearance of the MFP 100 and finisher 304 will be explained with reference to FIG. 3. A scanner unit 301 serving as an image input device illuminates an image on paper serving as a document, and scans a CCD line sensor to convert the image of the document set on the scanner 208 into electrical image data. The color and size of the document are determined from the electrically converted image data.

A printer unit 302 serving as an image output device converts image data into an image on paper. After printing on paper, the printed paper undergoes stapling or folding, such as bookbinding, and then is output. The print operation starts and stops in accordance with instructions from the controller CPU 201. Reference numeral 303 denotes an operation unit; and 304, a finisher. The finisher 304 is detachable from the MFP 100. Depending on the type of the finisher 304, another sheet processing apparatus can be connected to the finisher 304. Details of this arrangement will be described later with reference to FIG. 8.

<Arrangement of Operation Unit>

Figure 4:
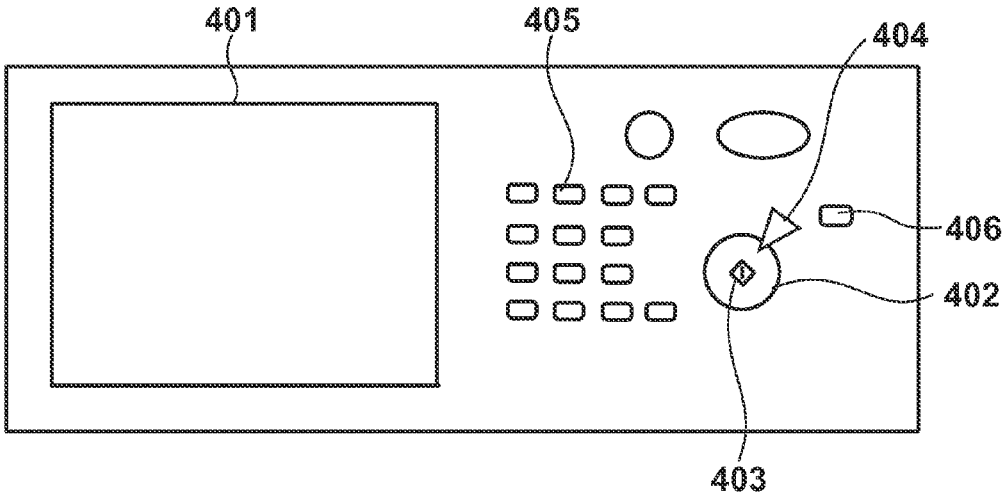
FIG. 4 is a view showing in detail the operation unit of the image forming apparatus according to the first embodiment.

The operation unit 303 will be described with reference to FIG. 4. The operation unit 303 includes a liquid crystal display 401, start key 402, two-color LED 403, stop key 404, ten-key pad 405, and user mode key 406. A touch panel sheet is adhered onto the liquid crystal screen of the liquid crystal display 401. The liquid crystal display 401 displays the operation screen of the system and soft keys. When the user presses a displayed key, the liquid crystal display 401 notifies the controller CPU 201 of the position information.

The start key 402 is used to start a document image reading operation. The two-color LED 403 which switches between green and red is arranged at the center of the start key 402, and its color represents whether the start key 402 is available. The stop key 404 is used to stop a running operation. The ten-key pad 405 is formed from numerical and character buttons, and used to designate setting of a copy count and switching of a screen on the liquid crystal display 401. The user mode key 406 is pressed to perform device settings.

<Screen Example>

Figure 5:
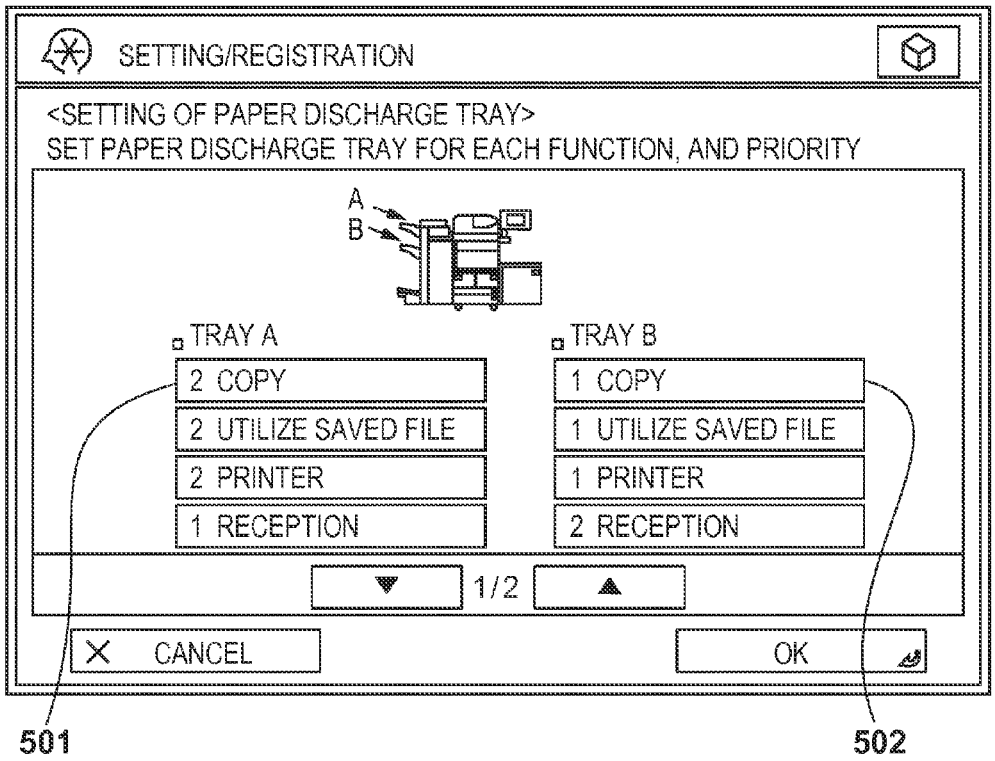
FIG. 5 is a view showing device information (paper discharge destination information) on the operation unit according to the first embodiment.

A setting screen for setting the priority of a paper discharge tray in the finisher 104 from a user mode screen for each function will be explained with reference to FIG. 5. In the example of FIG. 5, the finisher 104 includes two trays A and B, and the priority of each tray is settable for each function executable by the controller 101, such as "copy", "utilize saved file", "printer", or "reception".

Reference numeral 501 denotes assignment of functions to tray A; 502, assignment of functions to tray B. In the example of FIG. 5, for the "copy" function priority "2" is set for tray A, and priority "1" is set for tray B. A smaller numerical value represents higher priority. At these settings, sheets having undergone copying are discharged to tray B prior to tray A, and when it is detected that tray B becomes full, the paper discharge destination is switched to tray A. The priority of each paper discharge tray is similarly set for each function such as "utilize saved file", "printer", or "reception". Note that the "utilize saved file" function is a function of printing image data saved in the DISK 211 in accordance with an instruction from the operation unit 106 and discharging paper. The "printer" function is a function of printing image data received from an external apparatus via the network interface 205 and discharging paper. The "reception" function is a function of printing image data received via a telephone line (not shown) and discharging paper.

Contents set via the screen of FIG. 5 are saved as paper discharge destination information in the memory 202 shown in FIG. 2 within the controller 101. Note that the paper discharge destination information (device information) is not limited to information indicating the priority orders of a plurality of trays, but may be information for determining, for each job, a tray for output so that paper is discharged only to the tray indicated by the information. The embodiment has described a function of switching the paper discharge tray function for each paper discharge tray function. However, the data contents are not particularly limited as long as the data needs to be held in the memory 202 of the controller 101 in association with the finisher 104.

<Processing Sequence>

Figure 6:
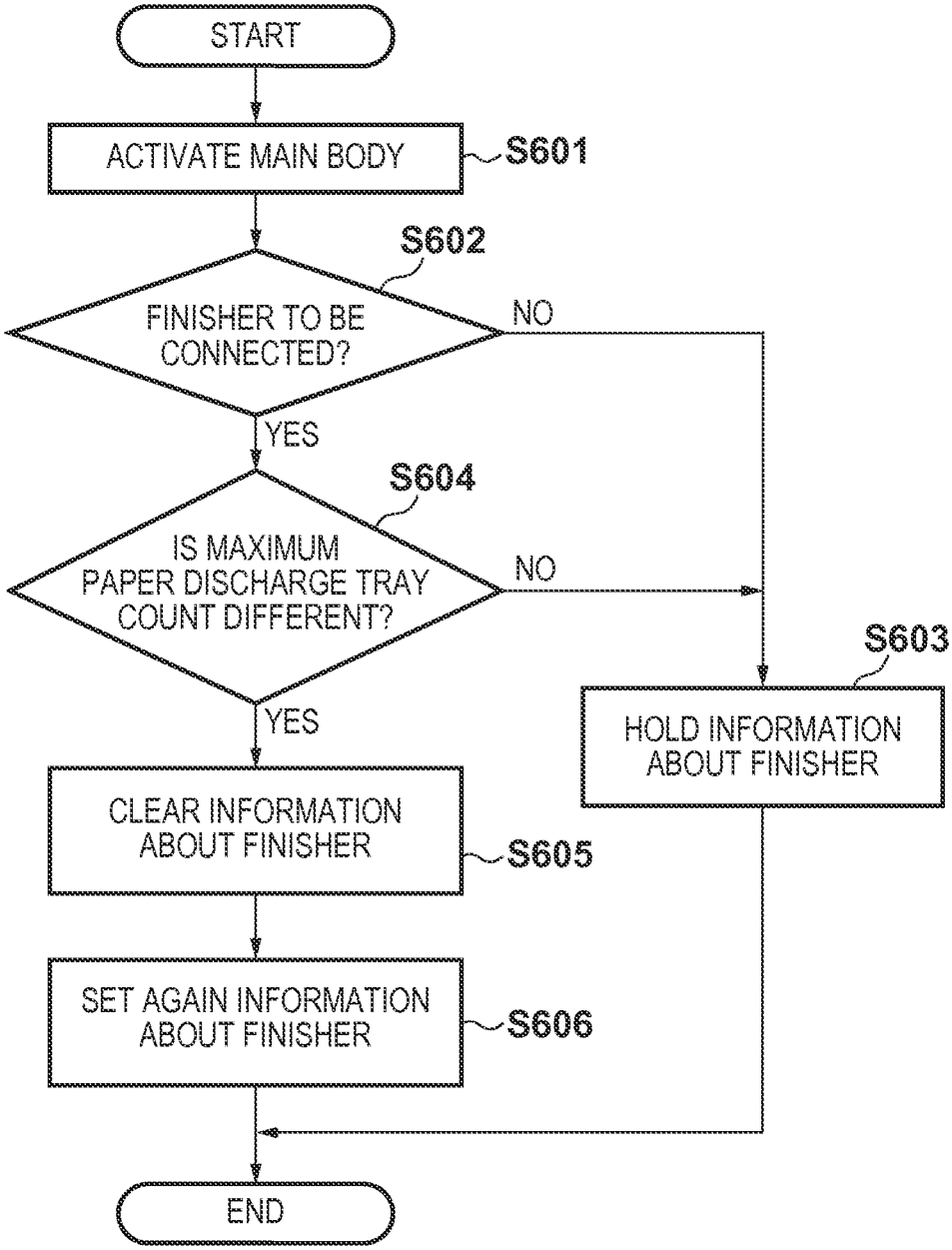
FIG. 6 is a flowchart showing a processing sequence to update device information (paper discharge destination information) based on finisher tray count information according to the first embodiment.

A characteristic processing sequence in the embodiment upon detachment/attachment of the finisher 104 will be explained with reference to FIG. 6. A method of holding data shown in FIG. 5 when the finisher 104 is disconnected from the printer engine 103 to leave the printer engine alone will be described with reference to FIG. 6. Note that the following processing is implemented by reading out a control program from the ROM 210, DISK 211, or the like to the memory 202 and executing it by the CPU 201.

In step S601, the CPU 201 receives a connection signal (connection information) from the finisher 104 to the controller 101 via the printer engine 103 at the timing when the MFP 100 is turned on. Note that the MFP according to the embodiment assumes that the user stops power supply to the MFP 100 when dismounting the sheet processing apparatus, connects a new sheet processing apparatus, and turns on the MFP 100 again. However, the present invention is not limited to this, and detachment/attachment of a sheet processing apparatus may be performed while the MFP 100 is kept ON.

In step S602, the CPU 201 determines whether it has received the connection signal, thereby determining whether the finisher 104 has been connected. If the finisher 104 has not been connected, the process advances to step S603, and the CPU 201 ends the process without performing any processing for data held in the memory 202 of the controller 101. The connection information is information representing that the finisher 104 serving as a sheet processing apparatus is connected to the MFP 100, and contains device information indicating information of the sheet processing apparatus. Note that the connection information contains the device information in this example, but the present invention is not limited to this. For example, the connection information may contain only information representing whether a sheet processing apparatus has been connected. In this case, the CPU 201 needs to separately acquire device information from a sheet processing apparatus from which the connection information has been received.

If the finisher 104 has been connected, the process advances to step S604, and the CPU 201 acquires device information about the paper discharge tray of the finisher 104 from the connection information. Further, the CPU 201 compares a finisher paper discharge tray count held in advance in the memory 202 with a paper discharge tray count contained in the acquired information about the paper discharge tray of the finisher 104. The paper discharge tray information held in advance in the memory 202 is information notified from an immediately previously connected finisher.

If the tray count held in the memory 202 is different from the tray count of the connected finisher 104 in step S604, the process advances to step S605. Even if no finisher has been connected before and the memory 202 does not hold the paper discharge tray count of an immediately previously connected finisher upon, for example, shipment of the MFP 100 from the factory, the CPU 201 advances the process to step S605. In step S605, the CPU 201 clears the finisher paper discharge destination information held in the memory 202 of the controller 101. In step S606, the CPU 201 sets the initial value of paper discharge destination information as paper discharge destination information of the newly connected finisher, and ends the process. The initial value of paper discharge destination information is stored in advance in the memory 202 for each tray count. Assume that when the tray count is 1, the priority of tray A is set to "1", and when the tray count is 2, the priority of tray A is set to "1" and that of tray B is set to "2". Also, assume that when the tray count is 3, the priority of tray A is set to "1", that of tray B is set to "2", and that of tray C is set to "3". In step S606, the CPU 201 may display a message on the operation unit 106 to prompt the user to set the priority of a paper discharge tray for a newly connected finisher.

If the tray count held in the memory 202 is equal to the tray count of the connected finisher 104 in step S604, the process advances to step S603, and the CPU 201 maintains the finisher paper discharge destination information held in the memory 202 of the controller 101. That is, the CPU 201 ends the process without changing the data held in the memory 202.

As described above, for example, when the image forming apparatus according to the embodiment is turned on upon detachment/attachment of a finisher, it acquires information containing a paper discharge tray count from a currently connected finisher. Further, the image forming apparatus compares the acquired paper discharge tray count with a paper discharge tray count held in advance in the memory or the like, and if they differ from each other, clears the finisher paper discharge destination information and again sets finisher paper discharge destination information. In this case, the paper discharge tray count held in advance in the memory etc. is paper discharge destination information of an immediately previously connected finisher. According to the embodiment, if the connected finisher is changed to another finisher having a different paper discharge tray count, information about the finisher is set again; otherwise, information held in advance is utilized without clearing information about the finisher. Hence, even when the user or service engineer temporarily disconnects a sheet processing apparatus (finisher), the image forming apparatus according to the embodiment can operate without setting again after reconnection a function of the image forming apparatus that is associated with the sheet processing apparatus.

<Second Embodiment>

Figure 7:
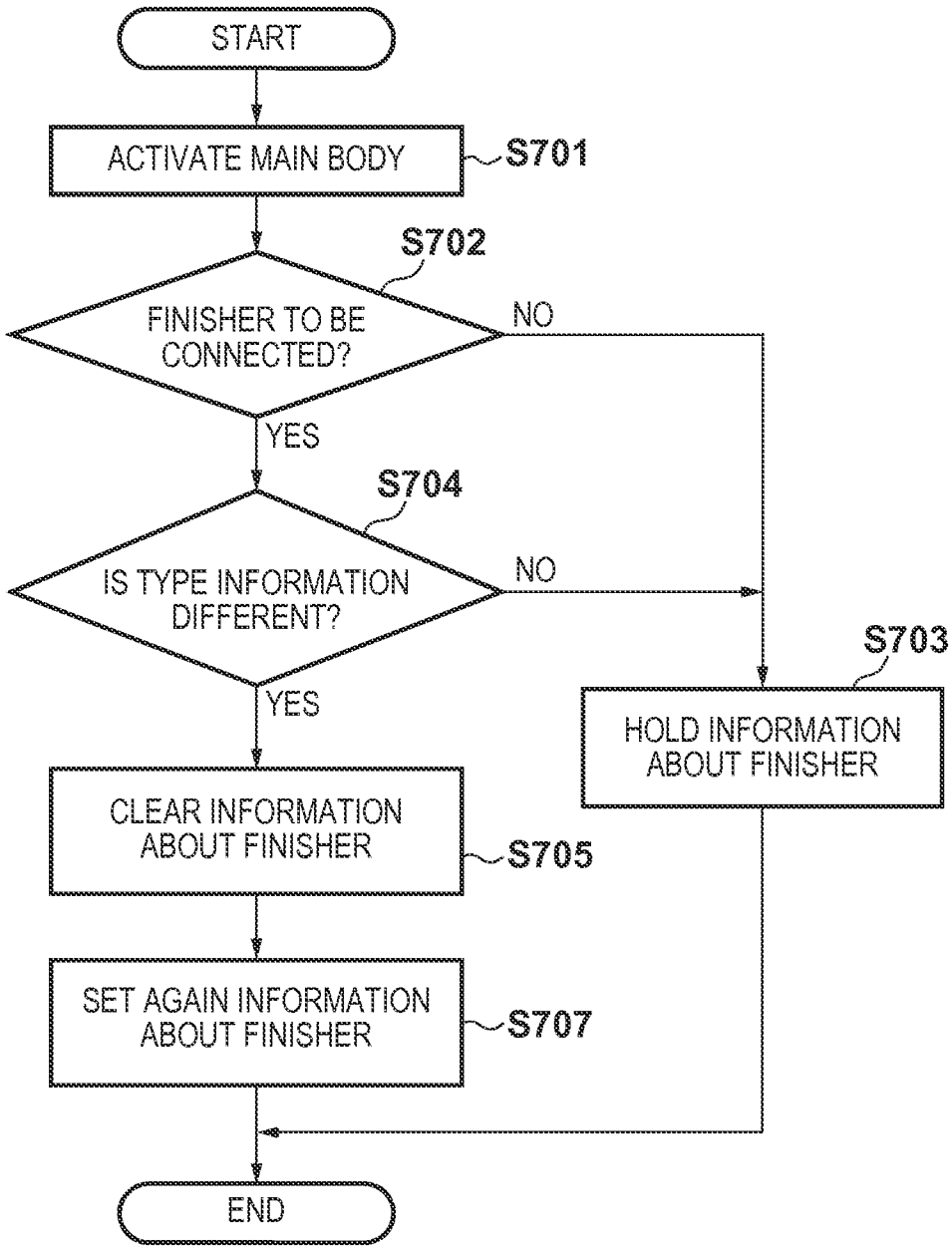
FIG. 7 is a flowchart showing a processing sequence to update device information (paper discharge destination information) based on finisher type information according to the second embodiment.

The second embodiment of the present invention will be described with reference to FIG. 7. Note that a description of the same arrangement and control as those in the first embodiment will not be repeated. FIG. 7 is a flowchart for explaining a characteristic processing sequence in the embodiment upon detachment/attachment of a finisher 104. Note that the following processing is implemented by reading out a control program from a ROM 210, DISK 211, or the like to a memory 202 and executing it by a CPU 201.

In step S701, the CPU 201 receives a connection signal from the finisher 104 to a controller 101 via a printer engine 103 at the timing when an MFP 100 is turned on. Upon receiving the connection signal, the CPU 201 determines in step S702 whether the finisher 104 has been connected. If the finisher 104 has not been connected, the process advances to step S703, and the CPU 201 ends the process without performing any processing for data held in the memory 202 of the controller 101.

If the finisher 104 has been connected, the process advances to step S704, and the CPU 201 acquires type information of the finisher 104. The CPU 201 then compares the acquired type information of the finisher 104 with finisher type information held in advance in the memory 202. The type information held in advance in the memory 202 is information notified from a finisher 104 immediately previously connected to the MFP 100. The type information need not be an ID specific to each finisher 104, but suffices to be an ID for specifying a finisher type. The type information held in advance in the memory 202 is information notified from an immediately previously connected finisher.

If the type information held in the memory 202 is different from the type information of the connected finisher 104 in step S704, the process advances to step S705. Even if no finisher has been connected before and the memory 202 does not hold type information upon, for example, shipment of the MFP 100 from the factory, the CPU 201 advances the process to step S705. In step S705, the CPU 201 clears the finisher paper discharge destination information held in the memory 202 of the controller 101. In step S706, the CPU 201 updates, in the memory 202, the initial value of finisher paper discharge destination information which is stored in the controller and assigned for each tray count. Then, the process ends. The initial value of paper discharge destination information is stored in advance in the memory 202 for each tray count. Assume that when the tray count is 1, the priority of tray A is set to "1", and when the tray count is 2, the priority of tray A is set to "1" and that of tray B is set to "2". Also, assume that when the tray count is 3, the priority of tray A is set to "1", that of tray B is set to "2", and that of tray C is set to "3". In step S706, the CPU 201 may display a message on an operation unit 106 to prompt the user to set the priority of a paper discharge tray for a newly connected finisher.

If the type information held in the memory 202 is identical to the type information of the connected finisher 104 in step S704, the process advances to step S703, and the CPU 201 maintains the data held in the memory 202 of the controller 101. That is, the CPU 201 ends the process without changing the data held in the memory 202.

<Third Embodiment>

Figure 8:
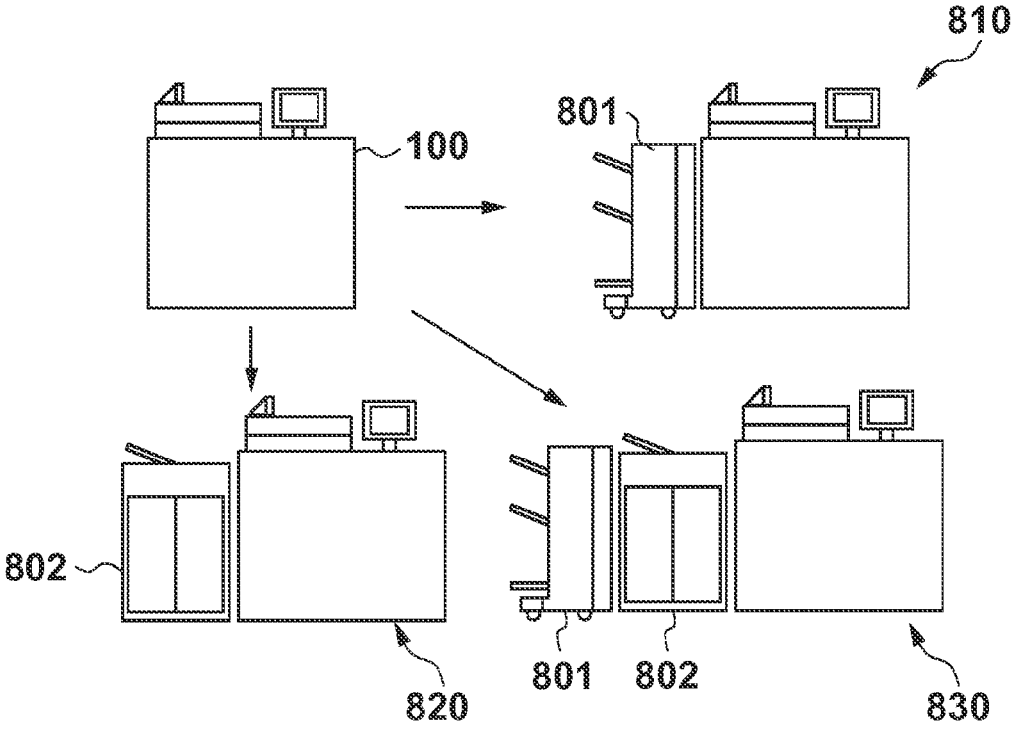
FIG. 8 is a view showing an image forming apparatus to which a plurality of apparatuses are connected according to the third embodiment.

The third embodiment of the present invention will be described with reference to FIGS. 8 and 9. Note that a description of the same arrangement and control as those in the first and second embodiments will not be repeated. In the third embodiment, a plurality of sheet processing apparatuses can be connected to an MFP 100, as shown in FIG. 8. As represented by 810, a finisher 801 is connected as an example of a sheet processing apparatus to the MFP 100 described in each of the first and second embodiments. The finisher 801 is identical to the finisher 104 in FIG. 1.

To the contrary, a plurality of sheet processing apparatuses can be connected to the MFP 100 in the third embodiment. For example, a stacker 802 capable of stacking a large volume of printed materials can be connected, as represented by 820. The finisher 801 and stacker 802 can be connected simultaneously, as represented by 830. The third embodiment will explain a finisher information update sequence when a plurality of sheet processing apparatuses 801 and 802 are connected, as represented by 830.

Figure 9:
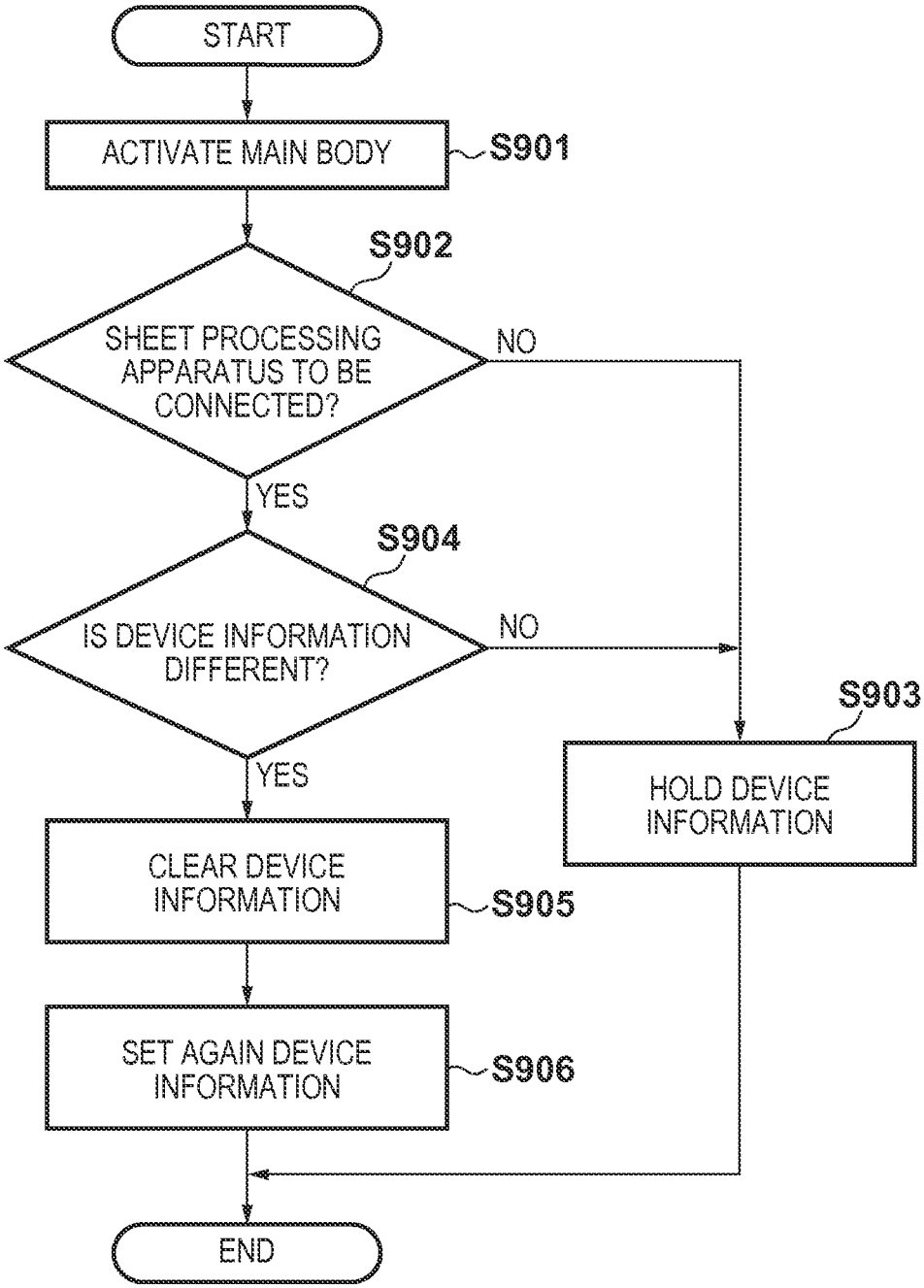
FIG. 9 is a flowchart showing a processing sequence to update device information (paper discharge destination information) when a plurality of apparatuses are connected according to the third embodiment.

FIG. 9 is a flowchart for explaining a characteristic processing sequence in the embodiment upon detachment/attachment of the finisher 801 and stacker 802. Note that the following processing is implemented by reading out a control program from a ROM 210, DISK 211, or the like, to a memory 202 and executing it by a CPU 201.

In step S901, the CPU 201 receives connection signals from the finisher 801 and stacker 802 to a controller 101 via a printer engine 103 at the timing when the MFP 100 is turned on. Upon receiving the connection signals, the CPU 201 determines in step S902 whether a sheet processing apparatus such as the finisher 801 or stacker 802 has been connected. If no sheet processing apparatus has been connected, the process advances to step S903, and the CPU 201 ends the process without performing any processing for data held in the memory 202 of the controller 101.

If a sheet processing apparatus has been connected, the process advances to step S904, and the CPU 201 acquires device information about a plurality of sheet processing apparatuses, and compares it with device information held in advance in the memory 202. The device information is information notified from the finisher 801 or stacker 802. The contents of device information can be tray count information described in the first embodiment, or type information described in the second embodiment.

If the device information held in the memory 202 is different from the device information of the connected sheet processing apparatus in step S904, the process advances to step S905, and the CPU 201 clears paper discharge destination information held in the controller 101. In step S906, the CPU 201 updates, in the memory 202, the initial value of paper discharge destination information stored in the controller. Then, the process ends. The initial value of paper discharge destination information is stored in advance in the memory 202 for each tray count. Assume that when the tray count is 1, the priority of tray A is set to "1", and when the tray count is 2, the priority of tray A is set to "1" and that of tray B is set to "2". Also, assume that when the tray count is 3, the priority of tray A is set to "1", that of tray B is set to "2", and that of tray C is set to "3". In step S906, the CPU 201 may display a message on an operation unit 106 to prompt the user to set the priority of a paper discharge tray for a newly connected finisher.

If the device information held in the memory 202 is identical to the device information of the connected sheet processing apparatus in step S904, the process advances to step S903, and the CPU 201 maintains the data held in the memory 202 of the controller 101. That is, the CPU 201 ends the process without changing the data held in the memory 202.

Note that paper discharge destination information is stored in the memory 202 of the MFP 100 in the above-described embodiments, but may be stored in the memory of the finisher 207 connected to the MFP 100. In this case, when a newly connected finisher 207 is of a type different from an immediately previously connected finisher 207, the MFP 100 acquires paper discharge destination information from the memory of the newly connected finisher 207, and determines a sheet discharge destination in accordance with the paper discharge destination information.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium). The program may be carried on a carrier medium such as a computer readable storage medium or transmission medium (signal).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-160306 filed on Jul. 21, 2011, which is hereby incorporated by reference herein in its entirety.

What is claimed is:

1. A printing apparatus, connectable to a sheet processing apparatus including a plurality of paper discharge destinations, comprising:

a storage control unit that stores, in a storage unit, information for determining a paper discharge destination to which a sheet is to be discharged from among the plurality of paper discharge destinations; and a control unit that, in a case where a newly connected sheet processing apparatus is a sheet processing apparatus of the same type as an immediately previously connected sheet processing apparatus, does not change the information stored in the storage unit, and in a case where a newly connected sheet processing apparatus is a sheet processing apparatus of a different type, updates the information stored in the storage unit.

2. The apparatus according to claim 1, further comprising a display unit that displays a screen for setting the information for determining a paper discharge destination to which a sheet is to be discharged from among the plurality of paper discharge destinations, wherein said storage control unit stores, in the storage unit, the information for determining a paper discharge destination to which a sheet is to be discharged from among the plurality of paper discharge destinations, which has been set via the screen.

3. The apparatus according to claim 1, wherein in a case where a newly connected sheet processing apparatus is a sheet processing apparatus of a different type, said control unit clears the information stored in the storage unit.

4. The apparatus according to claim 1, wherein in a case where a newly connected sheet processing apparatus is a sheet processing apparatus of a different type, said control unit sets an initial value to an area where the information is stored in the storage unit.

5. The apparatus according to claim 1, wherein the printing apparatus includes the storage unit.

6. The apparatus according to claim 1, wherein the sheet processing apparatus includes the storage unit.

7. The apparatus according to claim 1, wherein the information for determining a paper discharge destination to which a sheet is to be discharged from among the plurality of paper discharge destinations is information indicating priority for determining a paper discharge destination to which a sheet is to be discharged from among the plurality of paper discharge destinations.

8. A method for controlling a printing apparatus, connectable to a sheet processing apparatus including a plurality of paper discharge destinations, comprising:

storing, in a storage unit, information for determining a paper discharge destination to which a sheet is to be discharged from among the plurality of paper discharge destinations; and in a case where a newly connected sheet processing apparatus is a sheet processing apparatus of the same type as an immediately previously connected sheet processing apparatus, not changing the information stored in the storage unit, and in a case where a newly connected sheet processing apparatus is a sheet processing apparatus of a different type, updating the information stored in the storage unit.

9. A non-transitory computer-readable storage medium storing a computer program for causing a computer to execute a method for controlling a printing apparatus, connectable to a sheet processing apparatus including a plurality of paper discharge destinations, the program comprising:

storing, in a storage unit, information for determining a paper discharge destination to which a sheet is to be discharged from among the plurality of paper discharge destinations; and in a case where a newly connected sheet processing apparatus is a sheet processing apparatus of the same type as an immediately previously connected sheet processing apparatus, not changing the information stored in the storage unit, and in a case where a newly connected sheet processing apparatus is a sheet processing apparatus of a different type, updating the information stored in the storage unit.

* * * * *